United States Patent [19]

Hacknauer et al.

[11] Patent Number: 4,690,096

[45] Date of Patent: Sep. 1, 1987

[54] MAGNETIC BRUSH DEVELOPMENT APPARATUS HAVING A GATING AND METERING MECHANISM

[75] Inventors: Frank Hacknauer, Honeoye Falls; Salvatore C. DeFazio, Bergen; Richard S. Fox, Rochester, all of N.Y.

[73] Assignee: Eastman Kodak Company, Rochester, N.Y.

[21] Appl. No.: 944,895

[22] Filed: Dec. 22, 1986

[51] Int. Cl.[4] ..... G03G 15/09

[52] U.S. Cl. ..... 118/657; 118/658; 118/669; 118/672

[58] Field of Search ..... 118/657, 658, 669, 672

[56] References Cited

U.S. PATENT DOCUMENTS

| | | | |
|---|---|---|---|
| 3,523,518 | 8/1970 | Sage et al. | 118/637 |
| 3,575,139 | 4/1971 | Nuzum | 118/637 |
| 3,640,248 | 2/1972 | Nielander | 118/637 |
| 3,908,596 | 9/1975 | Smith | 118/637 |
| 4,391,503 | 7/1983 | Pugh | 355/3 DD |
| 4,422,405 | 12/1983 | Kasahara et al. | 118/658 |
| 4,452,173 | 6/1984 | Tabuchi et al. | 118/652 |
| 4,538,896 | 9/1985 | Tajima et al. | 355/3 R |
| 4,583,832 | 4/1986 | Kasamura et al. | 355/3 DD |

FOREIGN PATENT DOCUMENTS

| | | |
|---|---|---|
| 160830 | 11/1985 | European Pat. Off. . |
| 60-194476 | 10/1985 | Japan . |

*Primary Examiner*—Bernard D. Pianalto

*Attorney, Agent, or Firm*—G. Herman Childress

[57] ABSTRACT

In electrographic apparatus a magnetic brush development station has a housing with a sump for holding a supply of developer material, and a magnetic brush that applies developer material from the sump to a latent image on a photoconductor. A rotatable transport roller is located between the sump and the magnetic brush. A magnet in the roller attracts developer material from the sump to the roller so that rotation of the roller can move the material toward the magnetic brush. A gating and metering member in the form of a cylindrical tube is positioned around the roller and spaced from it. The tube has two elongate, spaced slots, and the tube is rotatable between first and second positions. When the tube is in one of its positions developer material from the sump can pass through one of the slots to the roller and be transported to the other slot where it is metered to the magnetic brush. When the tube is in its second position the slots are offset from the sump and the brush to block the flow of developer material to the transport roller and to the magnetic brush.

5 Claims, 2 Drawing Figures

MAGNETIC BRUSH DEVELOPMENT APPARATUS HAVING A GATING AND METERING MECHANISM

BACKGROUND OF THE INVENTION

The present invention relates to magnetic brush development apparatus for use with electrographic copiers/duplicators or the like and, more particularly, to an improved gating and metering mechanism for controlling the flow of developer material to the magnetic brush.

It is well known in the electrographic arts to use magnetic brush development apparatus for applying developer material to latent images on a photoconductor that is advanced past the magnetic brush. The developer material may initially be mixed in a sump to triboelectrically charge the material prior to delivering it to the developer roller of the magnetic brush apparatus.

It is also known to meter the flow of developer material to the magnetic brush and to gate or shut off the flow of material to the brush under certain circumstances. Metering of the developer material can be accomplished by a skive or by feeding the material through a slot leading to the magnetic brush. For example, in U.S. Pat. No. 4,538,896, toner is provided to a development station in a hopper. The hopper is closed by a plate that can be rotated to allow toner to fall through an opening in the hopper to a magnetic brush. Also, U.S. Pat. No. 3,523,518 discloses dispensing of toner from a cartridge having a series of holes therein by rotating the cartridge and allowing toner to fall through the holes in the cartridge under the influence of gravity.

It also is known to shut off the flow of developer material from a magnetic brush to a photoconductor in order to completely terminate the development of latent images on a photoconductor. For example, in color copiers having several magnetic brush development stations for applying toners of different colors to latent images it is known to move the stations relative to the photoconductor so that only one color toner at a time is applied to the photoconductor. Other ways of shutting off flow of developer material are known. See, for example, Japanese laid open patent publication No. 60-194476, published Oct. 2, 1985 and based on Japanese patent application number 59-48060. The Japanese publication teaches the delivery of developer material from a sump to a magnetic brush for developing latent images by means of a transport roll located between the sump and the magnetic brush. The magnetic brush comprises a developer roll that is rotated in one direction to delivery developer material from the transport roll to the photoconductor. When it is desired to shut off the flow of developer material to the photoconductor, the developer roll is stopped and then rotated in the opposite direction so that a developer-free part of the developer roll faces the photoconductor to thereby stop application of developer to the photoconductor.

While the known prior apparatus may work satisfactorily, in some cases they may be difficult to operate as, for example, when the entire station is moved between operable and inoperable positions relative to the photoconductor. In addition, some of the prior apparatus may not provide the degree of reliability, rapid response time desired to control the flow of developer material to the magnetic brush, or complete termination of developer flow when desired.

SUMMARY OF THE INVENTION

It is an object of the invention to provide magnetic brush apparatus with improved means for metering and gating the supply of developer material to a magnetic brush. Another object of the invention is to provide such apparatus which is relatively simple, easy and reliable to operate and which responds quickly.

The present invention can be used with a magnetic brush development apparatus for applying developer material to a latent image on a photoconductor. The apparatus has a housing with a sump for holding a supply of developer material, and a magnetic brush for applying developer material to the latent image. A rotatable transport roller is between the sump and the magnetic brush. A magnet in the roller attracts developer material from the sump to the roller. The improvement of the present invention relates to a gating and metering mechanism for controlling the flow of developer material to the magnetic brush. The mechanism comprises a gating member, positioned around at least part of the transport roller, and having first and second spaced openings. The gating member is movable relative to the transport roller between a first position wherein the first opening permits the flow of developer material from the transport roller through the opening of the gating member to the magnetic brush and the second opening permits the flow of developer material from the sump through the second opening of the gating member to the transport roller. The gating member can be moved to a second position wherein the openings are offset from the sump and the magnetic brush to block the flow of developer material from the sump to the magnetic brush by the transport roller.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
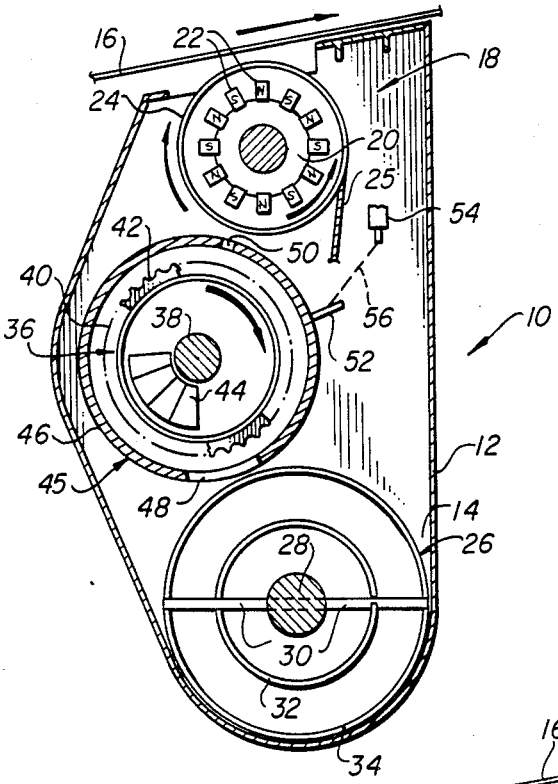
FIG. 1 is a fragmentary end view of a magnetic brush development apparatus incorporating the present invention with the gating and metering mechanism positioned to allow transport of developer material from the sump to the magnetic brush.

Referring now to the drawings, a development station of an electrographic apparatus is generally designated 10 and comprises a housing 12 that defines a sump 14 for receiving developer material. A photoconductor 16 travels across the upper portion of the housing 12 in the direction shown by the arrow and contains on its lower surface one or more latent electrostatic images that are developed by developer material from sump 14. The developed images can be transferred to a copy sheet and fused thereto in a known manner or fused onto the photoconductor itself.

The development station 10 has a magnetic brush 18 for applying developer material to the images on photoconductor 16. The brush illustrated comprises a core 20 having a plurality of magnets 22 spaced around the core, and a cylindrical, non magnetic shell 24 that surrounds the core 20. The core and/or shell can be fixed or rotatable, as known in the art. As illustrated in the drawings, the core 20 is rotatable in a counterclockwise direction, and the shell rotates in a clockwise direction to thereby feed developer material in a clockwise direction to the photoconductor. A blade 25 engages the shell 24 downstream of the development zone between the shell and photoconductor to remove unused developer material from the shell and return it to the sump.

Developer material in sump 14 can be mixed, agitated and triboelectrically charged by means of a ribbon blender generally designated 26. Blender 26 comprises a shaft 28 that is rotatable about its axis and has a plurality of rods 30 projecting therefrom. The rods carry inner and outer helical ribbons 32, 34. The pitch of the ribbon 32 is opposite from ribbon 34 so that when the shaft 28 is driven in a counterclockwise direction as shown in FIG. 1 ribbon 32 tends to drive developer material in one direction through the sump 14 while ribbon 34 tends to drive the material in the opposite direction. A ribbon blender is especially useful for mixing developer material having permanent magnetic carrier particles, such as disclosed in U.S. Pat. No. 4,546,060.

The electrographic apparatus as generally described hereinbefore is disclosed in more detail in European Patent Office Publication No. 160,830, published Nov. 13, 1985, which is based on U.S. patent application Ser. No. 597,323, filed Apr. 6, 1984. Reference is made to that publication for a more complete description of the apparatus.

Material from sump 14 is moved by the ribbon blender not only axially in the sump but also radially outwardly so that some of the material is provided to a feeding mechanism generally designated 36. The feeding mechanism is located between the top of the ribbon blender and the bottom of the magnetic brush. The feeding mechanism includes a shaft 38 that can be driven in a clockwise direction. A generally cylindrical transport roller 40 surrounds shaft 38 and is connected to it so that the roller is driven when the shaft is rotated. The outer surface of roller 40 is deeply fluted as shown at 42 to form a plurality of recesses and ridges that extend axially along the roller. The surface could also be grooved, or otherwise roughened or textured. The fluted surface picks up developer material from the lower quadrant of the gating member and transports it to the magnetic brush as described in more detail later. The roller can be made from any suitable material, such as extruded aluminum, plastic, etc.

Between the roller 40 and shaft 38 there is a stationary permanent magnet 44. The magnet is located beneath the shaft 38 and to the left thereof, and generally above and to the left of the ribbon blender 26. The magnet illustrated in the drawings extends through an arc of about 80 degrees. It is located so that developer material mixed by the ribbon blender is attracted to the outer surface of the roller 40 by the magnet 44 and held on the roller by the magnet as it is transported in a clockwise direction by the roller toward the magnetic brush. The position of the magnet, together with its arcuate dimension, assures that the material will be held onto the roller until it reaches a point where the material can be held onto the roller by the flutes 42 only. Developer material is then carried by the fluted surface through approximately 180 degrees or until it reaches approximately the right portion of the roller as viewed in FIG. 1 where it tends to be pulled from the fluted surface by gravity. Thus roller 40 helps to transport the developer material from the sump to a position where it can be attracted to the magnetic brush by the magnets 22 in the brush.

A gating and metering mechanism 45 includes a gating tube 46 which is positioned around the roller 40 and is spaced therefrom in order to provide an annular space for the flow of developer material between the roller and the tube 46. The tube is an elongate cylindrical member and can be made of plastic or other suitable materials. The tube is concentric with roller 40 and extends along the development station substantially the same distance as the magnetic brush 18. Tube 46 has an elongate, relatively wide slot 48 and a much narrower elongate slot 50. In the embodiment illustrated in the drawings, slots 48, 50 are approximately 205–210 degrees apart. The spacing of the slots depends, in part, on the location of the feeding mechanism 36 and gating mechanism 45 relative to the blender 26 and magnetic brush 18. The slots are spaced so that when the tube is in the position illustrated in FIG. 1 the wider slot 48 is substantially aligned with the bottom of roller 40 and between the magnet 44 and the ribbon blender. Also, when the tube is in the FIG. 1 position the slot 50 extends along the portion of tube 46 that is nearest to the shell 24 of the magnetic brush 18.

Slot 48 is relatively wide so that a substantial amount of developer material from sump 14 can pass through slot 48 and enter the space between tube 46 and roller 40 be transported by roller 40 to the slot 50. Slot 50, on the other hand, is much narrower and meters the desired amount of developer material to the magnetic brush. The slots may have various dimensions, depending upon a number of factors. By way of example, slot 48 can be approximately 0.50 inch wide and slot 50 can be approximately 0.045 inch wide. These dimensions can provide a developer flow rate of approximately 3.2 grams per inch per second to the magnetic brush.

Figure 2:
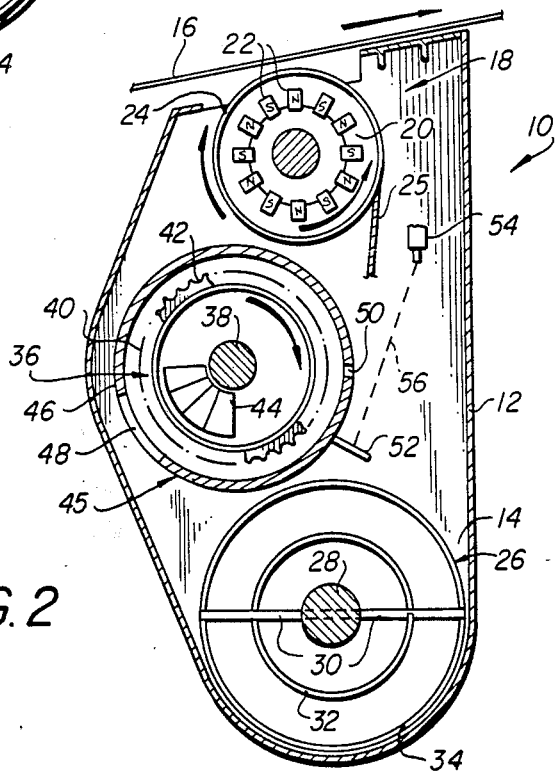
FIG. 2 is a view similar to FIG. 1 but showing the gating mechanism in a second position blocking the flow of developer material to the brush.

Tube 46 is oscillated between the positions shown in FIG. 1 and FIG. 2 to control the flow of developer material to the magnetic brush. Such movement can be accomplished in any suitable manner. For example, a pin 52 secured to the tube 46 can be coupled to a solenoid 54, as shown diagramatically at 56, so that the solenoid is effective to move the tube between its two positions. The solenoid can be controlled from the logic and control unit of the associated electrographic apparatus so that it is actuated at precisely the correct time relative to the movement of images on the photoconductor past the development station.

When the tube is in its FIG. 1 position slot 48 is between the ribbon blender and the magnet 44 so that developer material from the sump can be driven by the ribbon blender through the slot. Such material is attracted to roller 40 by the magnet 44. Roller 40 transports the material to the top of the roller where it is attracted toward the magnetic brush 18 by magnets 22 in the core of the magnetic brush. Thus some of the developer material will flow through the smaller slot 50 to the magnetic brush.

In order to shut off the flow of developer material to the magnetic brush, the tube is rotated approximately 60 degrees from its FIG. 1 position to its FIG. 2 position. At this time the larger slot 48 is spaced frm the ribbon blender and the sump so that material from the ribbon blender and sump cannot pass through the slot into the space between the tube 46 and roller 40. Also, the smaller slot 50 is spaced fromt he magnetic brush. When slot 50 is in its FIG. 2 position, any developer material flowing through the slot from the space between the tube 46 and roller 40 falls under the influence of gravity back into the sump 14. At this time the material is too far from the magnets 22 to be attracted to the magnetic brush.

Movement of the tube 46 between its two positions can be effected very rapidly to quickly and reliably start or stop the flow of developer material to the magnetic brush. This is especially desirable when the apparatus is used in color copiers where a series of similar development stations would be used, each with different colored toners, and wherein the flow of one color developer material to the magnetic brush must be stopped and started quickly and with great accuracy in order to avoid contamination of an adjacent image on the photoconductor.

The invention has been described in detail with particular reference to a preferred embodiment thereof, but it will be understood that variations and modifications can be effected within the spirit and scope of the invention as described hereinbefore and as defined in the appended claims.

We claim:

1. In a magnetic brush development apparatus for applying developer material to a latent image on a photoconductor, the apparatus having a housing with a sump for holding a supply of developer material, a magnetic brush for applying developer material to the latent image, a rotatable transport roller between the sump and the magnetic brush, and a magnet in the roller for attracting developer material from the sump to the roller, the improvement comprising:

a gating and matering mechanism for controlling the flow of developer material to the magnetic brush, the mechanism comprising a gating member positioned around at least part of the transport roller and having first and second spaced openings, and means for moving the gating member relative to the roller between (1) a first position wherein (a) the first opening is located relative to the roller and the magnetic brush to permit flow of developer material from the roller through the first opening to the magnetic brush and (b) the second opening is located relative to the sump and the magnet to permit flow of developer material from the sump through the second opening to the roller, and (2) a second position wherein the openings are offset from the sump and the magnetic brush to block the transport of developer material from the sump to the magnetic brush by the roller.

2. The invention as set forth in claim 1 wherein the gating member comprises a cylindrical tube concentrically positioned around the transport roller, the tube being spaced from the roller to provide a space for developer material being transported to the magnetic brush.

3. The invention as set forth in claim 1 wherein the transport roller has a fluted outer surface, the magnet in the roller is located at the lower portion of the roller for holding developer material onto the fluted surface during movement of developer material from the lower portion of the roller toward the upper portion of the roller, and the second opening is between the magnet and the sump when the gating member is in its first position.

4. The invention as set forth in claim 1 wherein the gating member is a cylindrical tube, the second opening is substantially larger than the first opening, and the openings comprise elongate slots in the tube.

5. In a magnetic brush development apparatus for applying developer material to a latent image on a photoconductor, the apparatus having a housing with a sump for holding a supply of developer material, a magnetic brush for applying developer material to the latent image, a rotatable transport roller between the sump and the magnetic brush, a magnet in the roller for attracting developer material from the sump to the roller, the improvement comprising:

a gating and metering mechanism for controlling the flow of developer material to the magnetic brush, the mechanism comprising a cylindrical gating tube surrounding the roller and spaced from the roller to provide a space for developer material being transported by the roller, the tube having first and second elongate slots extending axially along the tube, the first slot being narrower than the second slot, the gating tube being movable relative to the roller between a first position and a second position, the tube when in its first position (a) locating the first slot relative to the roller and the magnetic brush to meter developer material transported by the roller to the magnetic brush and (b) locating the second slot between the sump and the magnet to permit flow of developer material from the sump through the second slot to the roller, and the tube when in its second position locating the slots so that the slots are offset from the magnetic brush and the sump to block the transport of developer material from the sump to the magnetic brush by the roller.

* * * * *